United States Patent [19]

Braun et al.

[11] 4,103,832

[45] Aug. 1, 1978

[54] CRUSHER HAVING ROTATABLE ARMS WITH STRIKER TOOLS AND LIQUID SPRAY MEANS

[75] Inventors: Ernst Braun; Gert Braun, both of Essen-Heisingen, Fed. Rep. of Germany

[73] Assignee: Halbach and Braun, Fed. Rep. of Germany

[21] Appl. No.: 793,648

[22] Filed: May 4, 1977

[30] Foreign Application Priority Data

May 25, 1976 [DE] Fed. Rep. of Germany ..... 2623304

[51] Int. Cl.[2] ..... B02C 23/18

[52] U.S. Cl. ..... 241/38; 241/41; 241/67

[58] Field of Search ..... 241/38, 41, 42, 67

[56] References Cited

U.S. PATENT DOCUMENTS

| | | | |
|---|---|---|---|
| 1,988,473 | 1/1935 | Bennett | 241/41 |
| 3,124,312 | 3/1964 | Baricordi | 241/38 |
| 3,140,056 | 7/1964 | Motosi | 241/38 |
| 3,329,350 | 7/1967 | Wisgerhof et al. | 241/38 |

*Primary Examiner*—Granville Y. Custer, Jr.
*Attorney, Agent, or Firm*—McGlew and Tuttle

[57] ABSTRACT

A crusher for breaking up large size pieces of material, particularly for breaking up coal, comprises a housing with a crank therein which is pivotally mounted adjacent one end in said housing and is connected to means for oscillating the crank upwardly and downwardly in respect to a crusher plate. The crank carries a bracket portion which provides a rotatable mounting for the crusher roller which includes a shaft portion having a plurality of arms extending radially outwardly therefrom which have forward faces which carry striking tools. The arms provide means for conducting a liquid through the arms to a discharge nozzle which is oriented to spray in a direction opposite to the rotation direction behind the striking tools.

7 Claims, 2 Drawing Figures

CRUSHER HAVING ROTATABLE ARMS WITH STRIKER TOOLS AND LIQUID SPRAY MEANS

FIELD AND BACKGROUND OF THE INVENTION

This invention relates in general to the construction of crushers and, in particular, to a new and useful crusher which includes a rotatable crusher shaft mounted on an oscillating crank arm and which carries a plurality of radially extending arms having striking tools and with spray means directed in a direction opposite to the direction of rotation of the arms with the striking tools.

DESCRIPTION OF THE PRIOR ART

The present invention relates to a single-roll crusher for breaking up large size pieces of material, particularly coal or other minerals, comprising a fork crank bracket which oscillates about a horizontal axis, a crushing roller mounted on the bracket and having a shaft carrying stiking tools which include striking arms, striking heds, and rearwardly located mounting recesses for the striking heads, and a crusher plate which is associated with the striking tools and spaced from the crushing roller by a distance defining the vertical passage clearance for the material to be crushed.

In the operation of single-roll crushers, there is the permanent problem of setting the dust produced during the crushing of the material. An arrangement of fixed spray nozzles is known for solving this problem, wherein the nozzles are directed onto the material to be crushed. Such a measure is unsatisfactory, however, since the dust which is produced or set free for the most part only in the course of crushing of the material is entrained by suction by the striking arms of the tools and forms clouds of dust. Consequently, and despite such spraying, there is considerable pollution of the entire ambience of the crusher. In order to avoid this pollution, single-roll crushers have been equipped with steadying casings for settling the dust. However, this provision, aside from the constructional expenditures, does not suppress the dust satisfactorily.

SUMMARY OF THE INVENTION

The present invention is directed to a single-roll crusher for breaking up large size pieces of material having spraying nozzles on the movable arms so as to obtain an optimum settling of the dust, whereby, the air pollution is reduced to a minimum.

To this end, in accordance with the invention, the shaft of the crushing roller and the striking arms of a single-roll crusher are provided with spray channels which terminate in rearwardly located mounting recesses of the striking heads. Spray nozzles are mounted in these recesses and are connected to the spray channels and directed against the direction of rotation of the striking tools so that they discharge the spray into the strike shadow area of the striking tools. In a preferred embodiment of the invention, the spray nozzles are oriented substantially tangentially to the circular path followed by the revolving striking heads. The result of these provisions is that the space behind the striking tools where dust clouds form is indirectly, tangentially, sprayed. Thereby, the dust clouds which form behind the striking tools due to the suction effect are sprayed in the process of their formation and, consequently, settle instantly. This means that an optimum trapping of the dust and minimum air pollution are obtained by the invention, and these are the substantial advantages over the prior art.

There are still other features of the invention to be considered. Thus, an axial, central channel in the crushing roller shaft and radial distributing channel branched therefrom in the zone of the striking tools are provided as spray conveying passages. In accordance with the invention, tube lengths having a larger diameter than the radial distributing channels in the roller shaft and extending in the longitudinal direction of the striking arms are inserted in respective bores of the arms and the shaft to form the spray channals, and gasket rings are provided at their junctions with the distributing channels. This results in constructional advantages and, in particular, due to the larger outside diameter of the pipe lengths and the interposed gasket rings, the connection of the pipe lengths to the distributing channels is quite satisfactory. Because of the unequal diameters, the manufacturing tolerances of the roller shaft and the striking arms are easily compensated. In addition, the invention provides that in the zone of the mounting recesses, pipe bends are connected to the pipe lengths and the spray nozzles are inserted in the bends. Therefore, the spray nozzles can be easily exchanged. Advantageously, the spray nozzles are inserted in the pipe bends with the swing bearings in the form, for example, of ball-and-socket joints, and thus are made adjustable to a discharge in any direction. Consequently, the direction of discharge of the nozzles may be deviated not only from the tangential plane but also from the vertical plane of the circular path followed by the revolving striking heads. An adjustment, for example, to a discharge toward the adjacent striking tool, which may be mounted on the roller shaft with a relative angular displacement of 180°, means that the striking area of the following, adjacent tool will be sprayed.

Accordingly, it is an object of the invention to provide a crusher for breaking up large pieces of material, in particular for breaking up coal, which comprises a rotatable crushing roller mounted for rotation on an oscillatable crank above a crushing plate and which includes a plurality of radially extending arms having crusher tools along the forward radial surfaces and having means for delivering a fuel spray outwardly from the trailing radial surfaces.

A further object of the invention is to provide a crusher for breaking up large size pieces of material, particularly coal, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
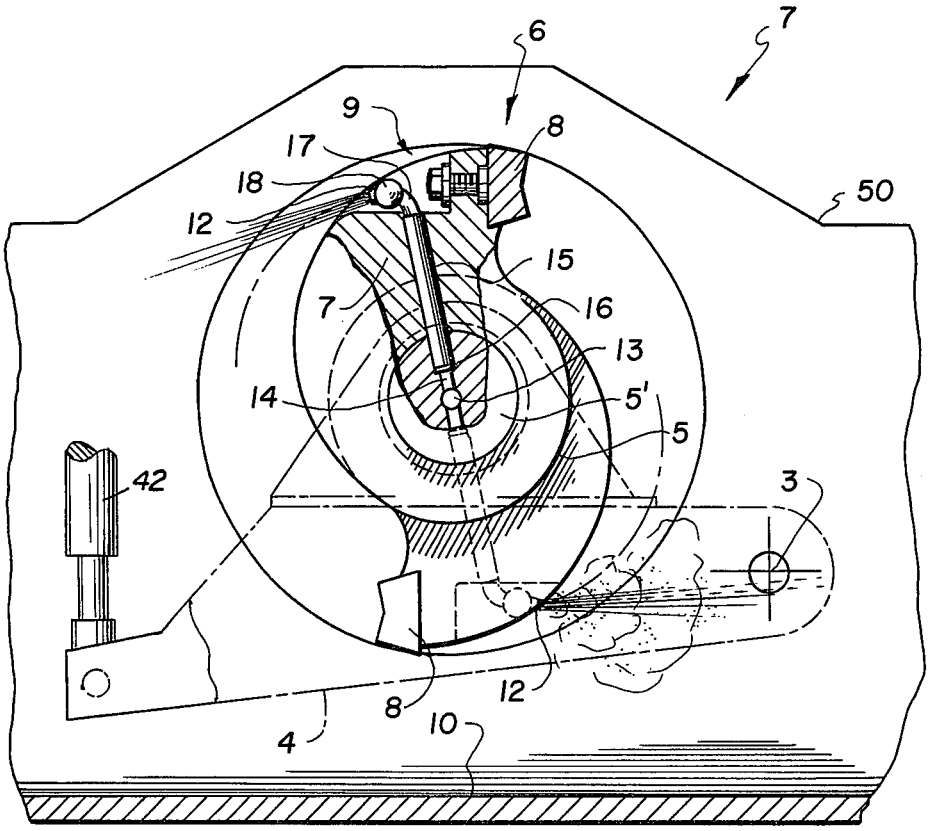
FIG. 1 is a partial front elevational and transverse sectional view of a crusher constructed in accordance with the invention.
Figure 2:
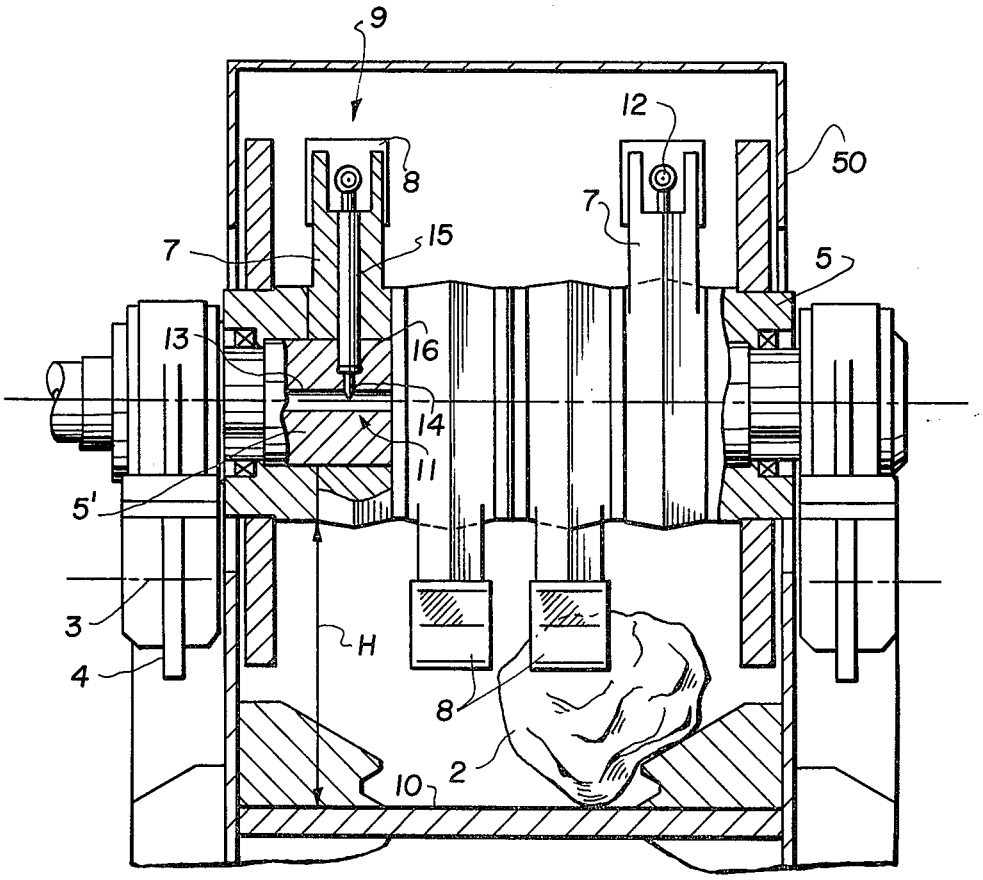
FIG. 2 is a partial longitudinal sectional view and elevational view of the crusher shown in FIG. 1.

Referring to the drawings in particular, the invention embodied therein, comprises a single-roll crusher, generally designated 7, which includes a housing 50.

The figures of the drawings show a single-roll crusher 7 for breaking up large size pieces of material 2, in particular coal or other minerals, comprising a housing 50 with a fork crank 4 pivotable on the housing about a horizontal axis 3. Oscillation means 42 is connected to the crank to oscillate it. A crushing roller 5 is mounted on crank 4 for rotation about an axis parallel to axis 3 and includes a rotatable shaft portion 5' carrying striking tools, generally designated 6. The tools 6 comprise striking arms 7 with forwardly directed striking heads 8, and rearwardly located mounting recesses 9 for striking heads 8 in respect to the rotational direction. A crusher plate 10 cooperates with the striking tools 6 and is spaced from the crushing roller 5 by a distance defining a vertical passage clearance H for the material 2 to be crushed. Roller shaft 5' and striking arms 7 are provided with spray channels or liquid conduits 11. The spray liquid used is preferably water. In principle, however, any other dust-trapping spray may be employed. In any case, spray channels 11 terminate in the mounting recesses 9 provided behind striking heads 8. Spray nozzles 12 are connected to the spray channels 11 in these recesses. Spray nozzles 12 are oriented so as to discharge against the direction of rotation of striking tools 6, with the effect that the strike shadow area of striking tools 6 or striking arms 7 is sprayed.

The orientation of spray nozzles 12 is substantially tangential to the circular path followed by the revolving striking heads 8, which path is indicated by a dash-dotted line. Roller shaft 5 is provided with a central, axial channel 13 wherefrom radial distributing channels 14, as spray channels, are branched off in the zone of striking tools 6. Striking arms 7 accommodate pipe lengths 15 inserted therein which extend in the longitudinal direction of the arms, and thus substantially also in the radial direction, and which have a larger diameter than the radial distributing channels 14 of roller shaft 5, so that a permanently satisfactory connection between pipe lengths 15 and distributing channels 14 is ensured. To this end, in addition, gasket rings 16 are inserted.

In the zone of mounting recesses 9, pipe bends 17 are fitted to pipe lengths 15 and spray nozzles 12 are inserted in bends 17. Spray nozzles 12 may also be connected to bends 17 by means of swing bearings or ball and socket parts 18, so as to be orientable in any direction. Orientation of nozzle 12 may be accomplished by manually moving it in the socket of the ball and socket joint 18. The instant spraying of the dust clouds entrained by the striking tools 6, before they can fully develop, is indicated in FIG. 1.

While a specific embodiment of the invention has been shown and described in detail to illustrate the application of the principles of the invention, it will be understood that the invention may be embodied otherwise without departing from such principles.

I claim:

1. A crusher for breaking up large size pieces of material, and particularly for breaking up coal, comprising a housing, a crank, pivotal support means pivotally supporting said crank adjacent one end of said crank on said housing, oscillation means connected to said crank to oscillate it about said pivotal support means, a crushing roller rotatably mounted on said crank having a shaft portion, a plurality of striking arms secured to said shaft portion for rotation therewith and extending radially outwardly from said shaft portion, a striking tool on each of said arms oriented forwardly in a direction of rotation of said arms, a crusher plate in said housing cooperable with said striking tools and spaced from said crushing roller by a distance defining a vertical passage clearance for material to be crushed therebetween, a liquid supply means including a conduit extending through at least one of said striking arms and having a discharge end, a spray nozzle on said discharge end directed in a direction opposite to the rotational direction of said arms so that the liquid is discharged in the shadow area of said striking tools.

2. A crusher, according to claim 1, wherein said spray nozzle is oriented substantially tangentially to the path of rotation of said striking tool.

3. A crusher, according to claim 1, wherein said liquid supply means includes a central axially extending channel defined in said shaft and at least one radial distributing channel branched off from said central channel and extending outwardly in said arm to said discharge end.

4. A crusher, according to claim 3, wherein said radial distributing channels include a first pipe portion and a second pipe portion of larger diameter than said first pipe portion, said first pipe portion being in said shaft, and a gasket ring disposed between said first and second pipe portions.

5. A crusher, according to claim 1, wherein said arms include a recess portion behind said striking tool, said nozzle being disposed in the recess portion and including a pipe bend connected to said nozzle forming a part of said liquid supply means.

6. A crusher, according to claim 5, including means for universally pivotally mounting said spray nozzle.

7. A crusher, according to claim 1, wherein there are a plurality of angularly spaced, radially extending striker arms, each having a forward face, said striking tool comprising a head member bolted to the forward face of said striker arm, the trailing face of said striker arm having a recess therein opposite to said head member, said spray nozzle being disposed in said recess.

* * * * *